US010352653B2

(12) United States Patent
Wasylko

(10) Patent No.: US 10,352,653 B2
(45) Date of Patent: Jul. 16, 2019

(54) HARNESS SYSTEM

(71) Applicant: Kristina D. Wasylko, Sagle, ID (US)

(72) Inventor: Kristina D. Wasylko, Sagle, ID (US)

( * ) Notice: Subject to any disclaimer, the term of this patent is extended or adjusted under 35 U.S.C. 154(b) by 291 days.

(21) Appl. No.: 14/999,313

(22) Filed: Apr. 23, 2016

(65) Prior Publication Data

US 2017/0307330 A1 Oct. 26, 2017
US 2019/0137217 A9 May 9, 2019

Related U.S. Application Data

(60) Provisional application No. 62/152,432, filed on Apr. 24, 2015.

(51) Int. Cl.
*F41C 33/04* (2006.01)

(52) U.S. Cl.
CPC ..... *F41C 33/048* (2013.01); *F41C 33/046* (2013.01)

(58) Field of Classification Search
CPC ..... F41C 33/04; F41C 33/041; F41C 33/043; F41C 33/045; F41C 33/046; F41C 33/048
USPC ..... 224/192, 193, 587, 625, 626, 637, 638, 224/639, 640, 641
See application file for complete search history.

(56) References Cited

U.S. PATENT DOCUMENTS 297,268 A * 4/1884 Kepley ..... A45C 1/04 128/96.1
981,292 A * 1/1911 Lewis ..... F41C 33/0209 224/193
1,037,717 A * 9/1912 Audley ..... A45F 3/14 224/198
2,089,402 A * 8/1937 Murray ..... H01M 2/1005 182/3
2,396,118 A * 3/1946 Ohlemeyer ..... A45F 3/14 224/198
2,579,782 A * 12/1951 Booth ..... A45F 3/14 224/624
3,797,715 A * 3/1974 Scialdone ..... A45F 3/14 224/587
3,901,579 A * 8/1975 Demerest ..... A41D 13/01 2/326
4,258,871 A 3/1981 McMahon
4,262,832 A * 4/1981 Perkins ..... A41D 1/04 2/102
4,627,558 A * 12/1986 Bianchi ..... A45F 5/021 224/238

(Continued)

OTHER PUBLICATIONS

Deep Conceal LLC, The Handgun Holster for the Business Professional, "Shoulder Holsters," http://www.deepconceal.com/shoulder-holsters/, 2018, 2 pages.

(Continued)

*Primary Examiner* — Joshua E Rodden
(74) *Attorney, Agent, or Firm* — Seed IP Law Group LLP

(57) ABSTRACT

A concealed weapon holster harness and cover convertible between a halter-top configuration and a back crisscross configuration has a first body portion and similar second body portion that releasably and adjustably interconnect using a plurality of spacedly arrayed hook and loop fastener patches to provide infinite adjustability about a user's torso just under the bust area. A halter strap or two crossing back straps secure the apparatus to a user's upper body and a covering conceals the apparatus and any carried firearm from view.

19 Claims, 7 Drawing Sheets

(56) References Cited

U.S. PATENT DOCUMENTS 4,750,652 A * 6/1988 Grant ..... A45F 5/00 224/579
4,785,983 A 11/1988 DeSantis
4,903,874 A * 2/1990 Shoemaker ..... A45F 3/14 2/327
5,170,919 A 12/1992 DeSantis et al.
5,687,891 A * 11/1997 Beletsky ..... F41C 33/0227 224/243
5,718,363 A 2/1998 Graves
5,775,558 A * 7/1998 Montalbano ..... A45F 3/14 224/605
5,894,976 A * 4/1999 Harper ..... A45F 5/00 224/198
5,943,700 A * 8/1999 Hammer ..... A63B 21/065 2/102
6,119,907 A 9/2000 Benjamin
6,443,347 B1 * 9/2002 Elizalde ..... A45F 3/14 224/245
6,568,575 B1 * 5/2003 Bartholomew ..... A45F 3/14 224/258
7,631,368 B1 * 12/2009 Samson ..... F41C 33/02 2/115
D658,364 S * 5/2012 Davis ..... D3/222
9,587,908 B2 * 3/2017 Bjelde ..... F41C 33/007
2003/0034366 A1 2/2003 Sloan
2004/0104569 A1 * 6/2004 Berger ..... B60R 22/024 280/801.1
2011/0093996 A1 * 4/2011 Henriquez ..... F41C 33/046 2/2.5
2012/0187164 A1 7/2012 Looper et al.
2013/0320055 A1 12/2013 King
2014/0131410 A1 5/2014 Looper et al.
2015/0233670 A1 * 8/2015 Galoob ..... F41C 33/0236 224/587

OTHER PUBLICATIONS

Farago, the Truth About Guns, "The Truth About Kydex Holsters," http://www.thetruthaboutguns.com/2014/02/robert-farago/truth-kydex-holsters/, 2014, 24 pages.
Pistolwear, Pistol Wear Holsters for Concealed Handguns, "Trump Card Concealment Holster," http://www.pistolwear.com/trump-card-concealment-holster/, 2018, 3 pages.
UnderTech UnderCover, "Women's Concealed Carry Tank Top," https://www.undertechundercover.com/products/utuc-womens-concealment-tank-top?variant=30361045318, 2018, 4 pages.

* cited by examiner 47
46
45
45A
45B
31A
50
35
41
40
30
34
36
42
33A
33
43
32A
22A
22
25
20
23A
23
24
26
21
21A
66
60
80

HARNESS SYSTEM

RELATED APPLICATIONS

This application claims benefit to U.S. provisional patent application No. 62/152,432, filed on Apr. 24, 2015.

FIELD OF INVENTION

The present invention relates to firearms, and more particularly to an apparatus for carrying a concealed firearm such that the firearm and its holding apparatus is secured to a wearer's body, is sufficiently hidden to prevent visual detection and yet is readily accessible for use.

BACKGROUND

Gun ownership and the right to bear arms is a Constitutionally protected right of all US Citizens.

Coincident with this right, many people (men and women) choose to carry weapons on their body while engaged in day-to-day activities using a variety of known firearm carrying apparatus.

A holster is one such known apparatus which allows a user to carry a firearm which is readily accessible, and still maintain the use of both hands.

The carrying of a pistol type gun (hereinafter a "firearm" and/or "weapon") has historically been an activity almost exclusively of men. However, with the development of smaller firearms, in particular self-defense pistols, women have increasingly become concealed weapon carriers.

Uniformed law enforcement and military users may use visible weapon holsters carried on the outside of their clothing. However, for persons who desire to carry a firearm that is concealed from view, a concealed holster is beneficial because members of the public will not know the user is carrying a weapon and, other people will not be unnecessarily preoccupied by the weapon's presence since they are unaware of it.

Typically holsters are worn at the waist and are secured thereabout by a heavy leather belt. Holsters are also available for securing a firearm to an ankle, a thigh and a shoulder. These types of holsters are commonly worn under loose clothing to conceal their presence from the general public. Shoulder and waist versions are commonly worn over the clothing and concealed by a sports coat. However, the majority of women do not wear sports coats and many women's garments are more fitted and will not adequately conceal a weapon. Much of the prior art, although designed for men, can be used by women, however, the majority of holsters aren't designed specifically for women and do not accommodate a woman's body shape nor a woman's typically more fitted clothing.

Purse and handbag holsters are known for women, but present a challenge when the woman needs to quickly access the weapon. If the holster is not secured to the inside of the bag, it can get misplaced amongst the many items stored in the purse. In addition, there is also a safety issue, if the woman ever leaves her purse unattended, as if during a meal, at work, driving or shopping. Also, purse/handbag holsters are of no use to a woman whose purse has been stolen.

The present invention is an improvement to known concealed weapon carrying apparatus because it is specifically designed to accommodate the female body. The present invention uses the natural contours of the female physique in concealing the weapon and also natural clothing worn by many women to provide additional concealment.

The instant invention overcomes various of the aforementioned drawbacks to concealed weapons holsters by providing a concealed weapon holster and harness and cover that a woman may wear with her daily wardrobe.

Some or all of the problems, difficulties and drawbacks identified above and other problems, difficulties, and drawbacks may be helped or solved by the invention shown and described herein. The instant invention may also be used to address other problems, difficulties, and drawbacks not set out above or which are only understood or appreciated at a later time. The future may also bring to light currently unknown or unrecognized benefits which may be appreciated, or more fully appreciated, in the future associated with the novel invention shown and described herein.

BRIEF SUMMARY OF THE INVENTION

A concealed weapon holster harness and cover convertible between a halter top configuration and a back crisscross configuration to accommodate a woman's body shape and clothing choice.

In providing such a concealed weapon holster harness and cover it is:

a principal object to provide a concealed weapon holster harness and cover that conceals a carried weapon;

a further object to provide a concealed weapon holster harness and cover that securely holds the weapon adjacent to a person's body such that both hands are free for other tasks;

a further object to provide a concealed weapon holster harness and cover that may be concealed with a variety of clothing items;

a further object to provide a concealed weapon holster harness and cover that is convertible from a back crisscross strap configuration to a halter top configuration;

a further object to provide a concealed weapon holster harness and cover that is easily donned;

a further object to provide a concealed weapon holster harness and cover that is easily removed;

a further object to provide a concealed weapon holster harness and cover that may be worn underneath a woman's clothing;

a further object to provide a concealed weapon holster harness and cover that may be worn over a woman's clothing;

a further object to provide a concealed weapon holster harness and cover that is infinitely adjustable;

a further object to provide a concealed weapon holster harness and cover that accommodates a variety of weapon holsters;

a further object to provide a concealed weapon holster harness and cover that is comfortable to wear;

a further object to provide a concealed weapon holster harness and cover that extends simultaneously about the female user's torso under the bust area and over the user's shoulders;

a further object to provide a concealed weapon holster harness and cover that extends simultaneously about the female user's torso under the bust and about the back of the user's neck; and a still further object to provide a concealed weapon holster harness and cover that a woman may wear with a backless garment.

Other and further objects of the instant invention will appear from the following specification and accompanying drawings which form a part hereof. In carrying out the objects of the invention it is to be understood that its structures and features and steps are susceptible to change in design and arrangement and order with only one preferred and practical embodiment of the best known mode being illustrated in the accompanying drawings and specified as is required.

BRIEF DESCRIPTION OF THE DRAWINGS

Preferred forms, configurations, embodiments and/or diagrams relating to and helping to describe preferred aspects and versions of the instant invention are explained and characterized herein, often with reference to the accompanying drawings. The drawings and features shown herein also serve as part of the disclosure of the invention, whether described in text or merely by graphical disclosure alone. The drawings are briefly described below.

DETAILED DESCRIPTION

Figure 1:
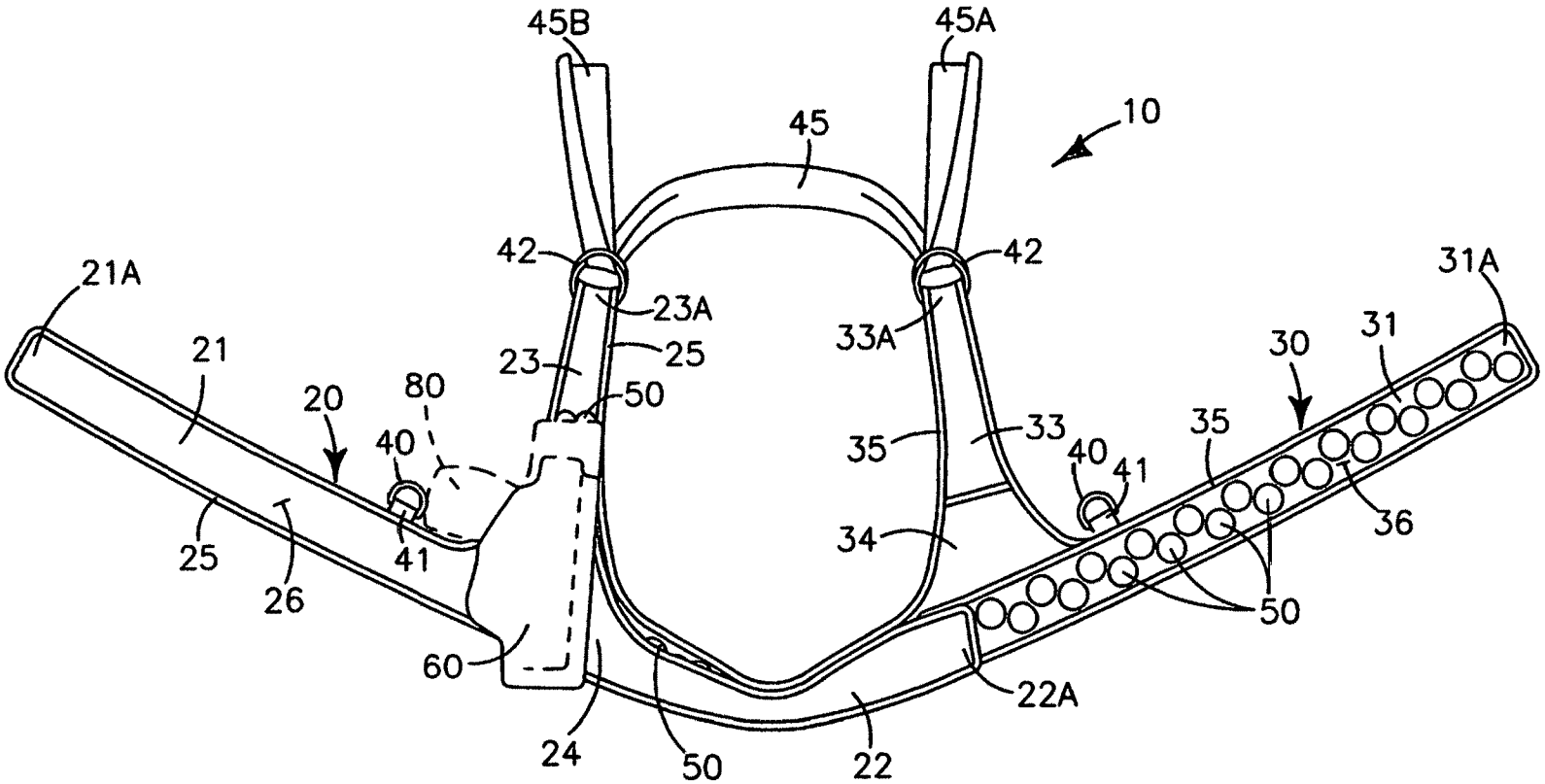
FIG. 1 is an orthographic front view of the concealed weapon holster harness in a halter top configuration.

The readers of this document should understand that dictionaries were used in the preparation of this document. Widely known and used in the preparation hereof are *The American Heritage Dictionary of the English Language*, (4$^{th}$ Edition © 2000), *Webster's New International Dictionary*, Unabridged, (Second Edition © 1957), *Webster's Third New International Dictionary* (© 1993), *The Oxford English Dictionary* (Second Edition, © 1989), and *The New Century Dictionary* (© 2001-2005), all of which are hereby incorporated by this reference for interpretation of terms used herein and to more adequately or aptly describe various features, aspects and concepts shown or otherwise described herein using words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text of both Claims and Abstract are incorporated by this reference into the description entirely.

The readers of this document should further understand that the embodiments described herein may rely on terminology and features used in any section or embodiment shown in this document and other terms readily apparent from the drawings and language common or proper therefore.

As used herein, the term "front", its derivatives and grammatical equivalents refers to that portion of the instant invention that is positioned proximate a user's anterior body surface when the instant invention is being worn by a user. The term "back", its derivatives and grammatical equivalents refers to that portion of the instant invention that is positioned proximate a user's posterior body surface. The term "side", its derivatives and grammatical equivalents refers to that portion of the instant invention that is positioned laterally to a user's anterior and posterior body surfaces.

The instant concealed weapon holster harness and cover generally comprises harness body 10, a holster 60 for carrying a firearm 80 and a cover 70.

The harness body 10 is preferably formed of elastic material that contours to the wearer's body. The harness body 10 has a first body portion 20 and a second body portion 30 that are releasably and adjustably interconnected to one another using plural hook and loop fastener patches 50 and a halter strap 45 or a pair of crossing back straps 46, 47. The patches 50 are placed in a checkerboard fashion creating the ability for infinite adjustment while maintaining the elastic quality of the straps 21, 22.

The first body portion 20 has a configuration similar to an Inverted "T" having a first leg 21, an opposing second leg 22, a vertical leg 23 and trunk portion 24 where proximate end portions of the first leg 21, the second leg 22 and the vertical leg 23 interconnect. The first leg 21 has an end portion 21A distal from the trunk 24. The second leg 22 has an end portion 22A distal from the trunk 24. Similarly, the vertical leg 23 has an end portion 23A distal from the trunk 24. Edge portions 25 of the first body portion 20 are hemmed in a manner known to those in the art of fabric working to prevent frays, rough edges and to create a professional clean appearance that is durable.

A ring 42 is carried in a ring loop (not shown) formed in the end portion 23A of the vertical leg 23. A single D-ring 40 is carried in a ring loop 41 on first leg 21 spacedly adjacent laterally the vertical leg 23 and extending generally upwardly from the hemmed edge 25. The single D-ring 40 and the ring 42 provide attachment means for the halter strap 45 and/or the crossing back straps 46, 47.

The first body portion 20 has an outer surface 26 that is positioned outwardly from user's body, and an interior surface (not shown) that is positioned proximate/adjacent the user's body.

In the preferred embodiment the interior surface (not shown) first body portion 20 carries a plurality of spacedly arrayed hook and loop type fastener patches 50 (hereinafter Velcro® patches) that are either a "hook portion" 51 or a "loop portion" 52 of the Velcro®.

Figure 7:
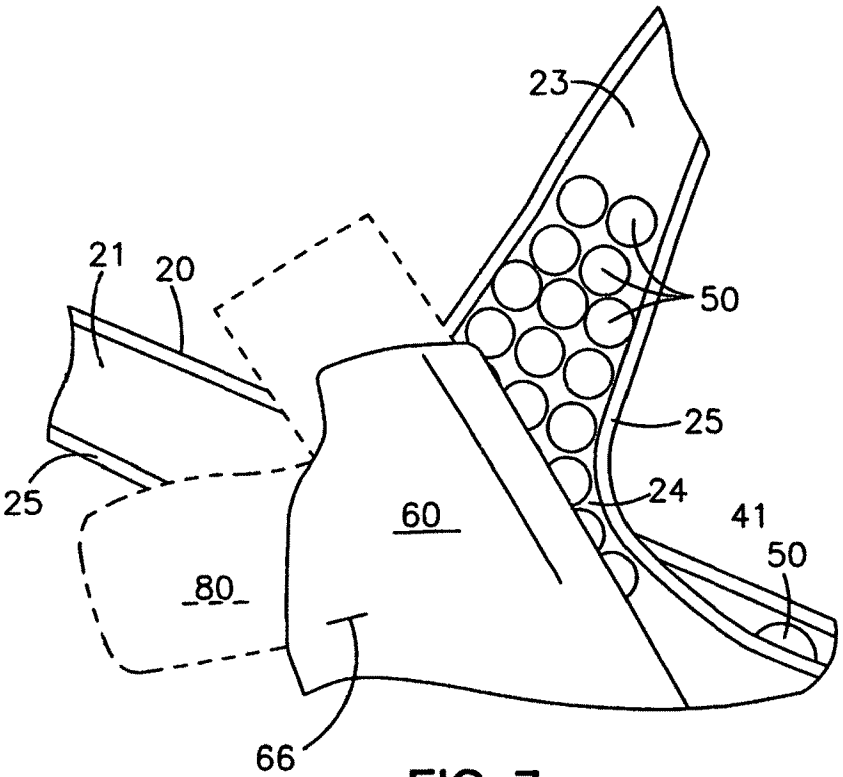
FIG. 7 is an enlarged partial cutaway orthographic side view of the weapon holster carrying a weapon attached to the holster harness.
Figure 6:
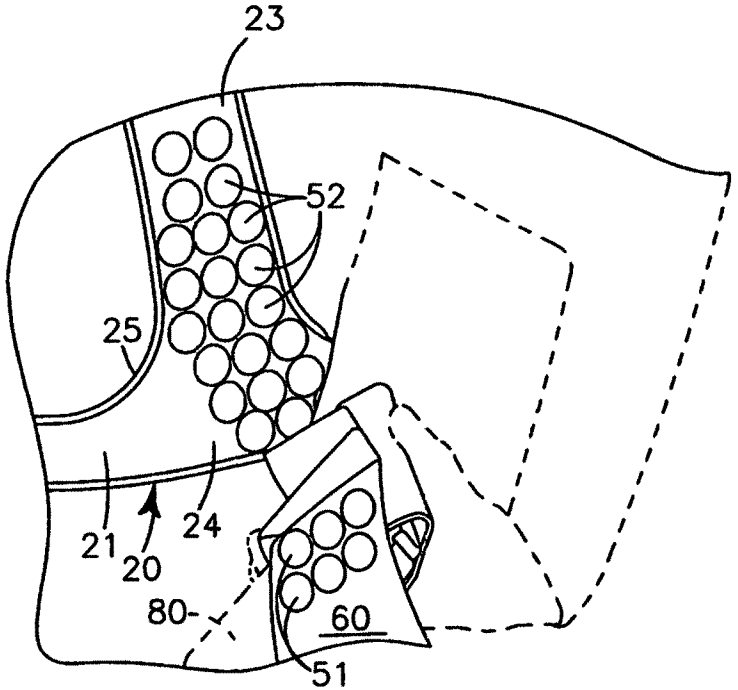
FIG. 6 is an enlarged partial cutaway orthographic side view of the weapon holster being attached to the Velcro® attachment patches of the first body portion.
Figures 10, 11:
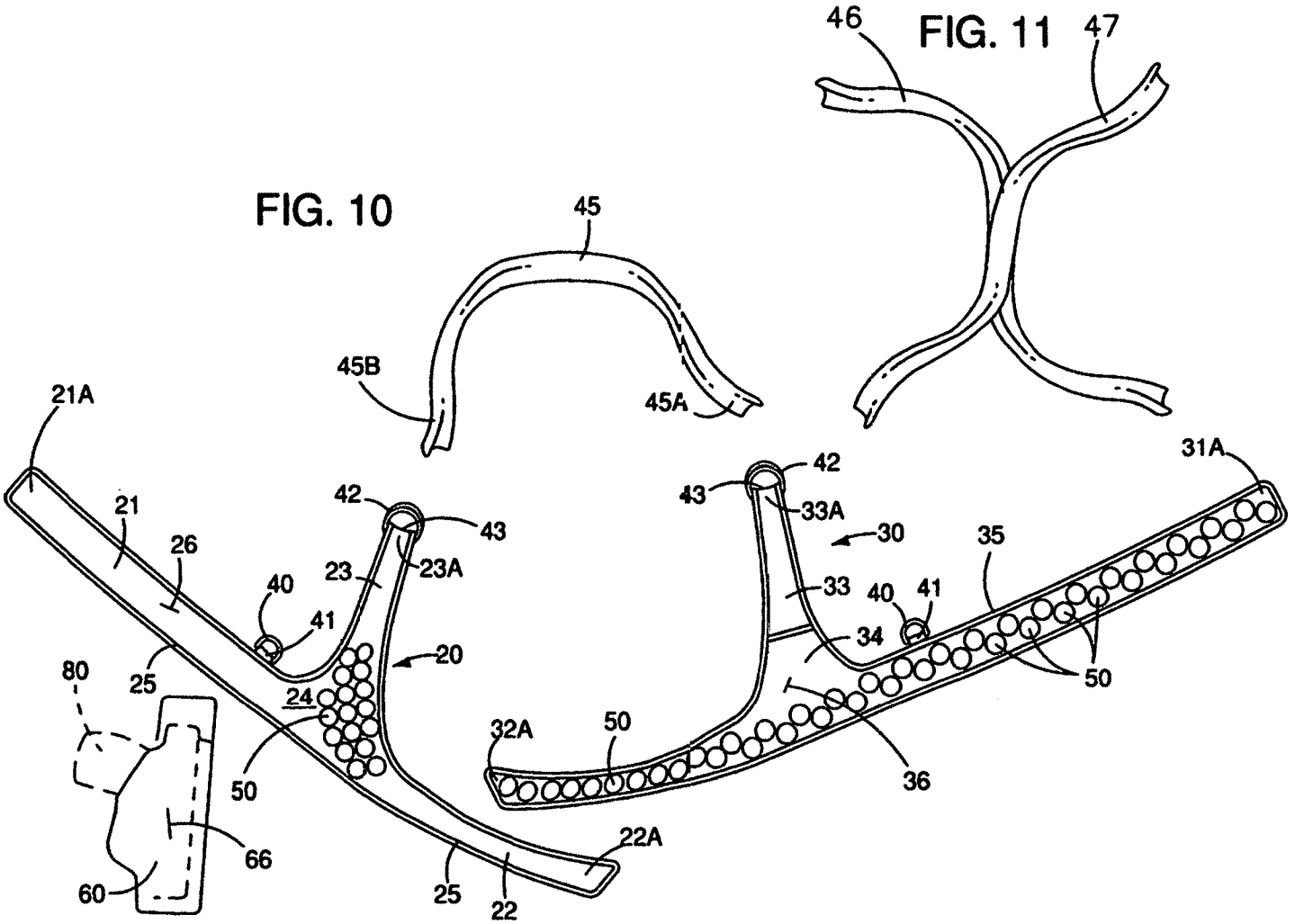
FIG. 10 is an orthographic front exploded view of the concealed weapon holster harness of FIG. 1 showing the components separated from one another.
FIG. 11 is an orthographic back view of the back crossing straps separated from the harness.

As shown in FIG. 6, FIG. 7 and FIG. 10 a plurality of Velcro® patches 50 are also carried on and about the trunk portion 24 of the first body portion 20 for releasable attachment of the holster 60 to the harness body 10. Although the Velcro® patches 50 are shown in the Figures as comprising individual disc-shaped "patches", the Velcro® patches 50 may be provided in any variety of configurations including, but not limited to, checkerboard configurations, strips, stripes and/or solid bands.

The second body portion 30 is similar to the first body portion 20 having a configuration similar to an inverted "T" having a first leg 31, an opposing second leg 32, a vertical leg 33 and a trunk portion 34 where proximate end portions of the first leg 31, the second leg 32 and the vertical leg 33 interconnect. The first leg 31 has an end portion 31A distal from the trunk 34. The second leg 32 has an end portion 32A distal from the trunk 34. Similarly, the vertical leg 33 has an end portion 33A distal from the trunk 34. Edge portions 35 of the second body portion 30 are similarly hemmed in a manner known to those in the art of fabric working to prevent frays, rough edges and to create a professional clean appearance that is durable.

Ring 42 is carried in ring loop (not shown) formed in the end portion 33A of the vertical leg 33. A single D-ring 40 is carried in a D-ring loop 41 on the first leg 31 spacedly adjacent laterally the vertical leg 33 and extending generally upwardly from the hemmed edge 35. The single D-ring 40 and the double D-ring 42 provide attachment means for the halter strap 45 and the crossing back straps 46, 47.

The second body portion 30 has an outer surface 36 that is positioned outwardly from the user's body, and an interior surface (not shown) that is positioned proximate/adjacent the user's body.

In the preferred embodiment the outer surface 36 of the second body portion 30 carries a plurality of spacedly arrayed Velcro® patches 50 that are either a "hook portion" 51 or a "loop portion" 52 (which-ever is the opposing type of Velcro® patches 50 carried on the inner surface (not shown) of the first body portion 20) to provide releasable engagement with the first body portion 20 and infinite adjustability therebetween.

As shown in FIG. 1, in use, the first body portion 20 and the second body portion 30 are joined together by interconnecting the plurality of Velcro® patches 50 carried on the inner surface (not shown) of the second leg 22 of the first body portion 20 with the plurality of Velcro® patches 50 carried on the outer surface 36 of the second leg 32 of the second body portion 30. "Pressing" together the plurality of Velcro® patches 50 carried on the first body portion 20 and the plurality of Velcro® patches 50 carried on the second body portion 30 causes the plurality of hooks carried by the hook portions 51 to interconnect with the plurality of loops carried by the loop portions 52, causing a secure interconnection therebetween.

Figure 3:
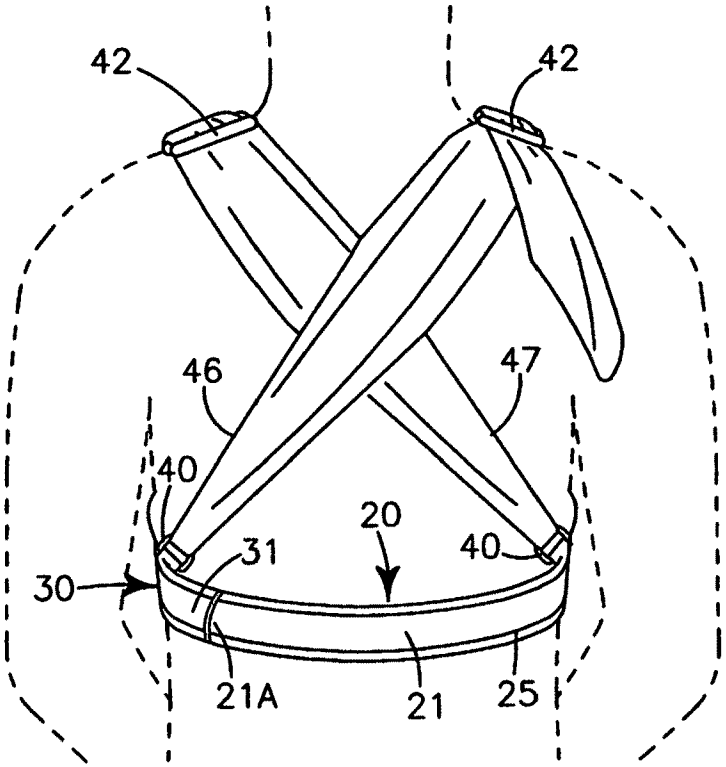
FIG. 3 is a partial cut-away back view of a person wearing the holster harness in a back crisscross configuration, the person shown in dashed outline.
Figure 2:
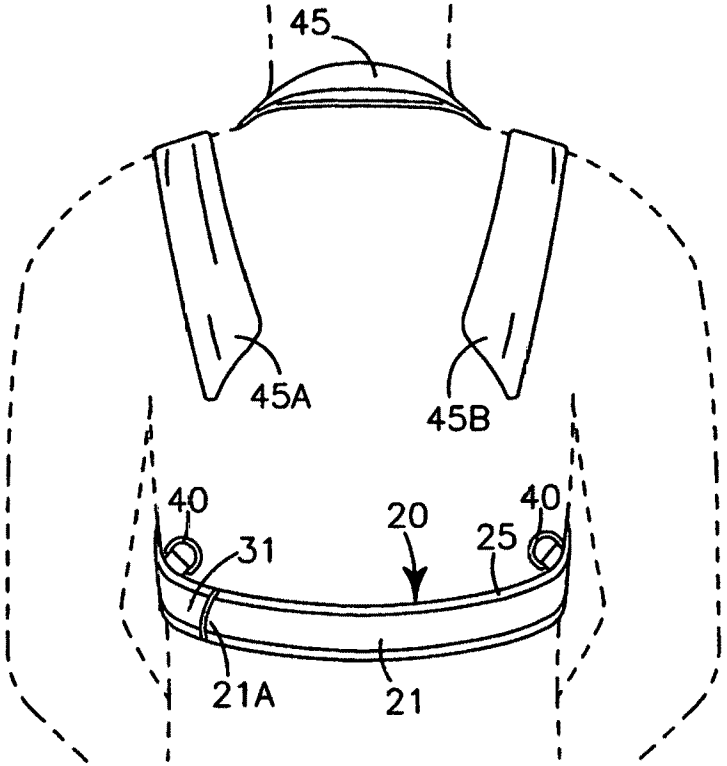
FIG. 2 is a partial cut-away back view of a person wearing the holster harness of FIG. 1, the person shown in dashed outline.
Figure 5:
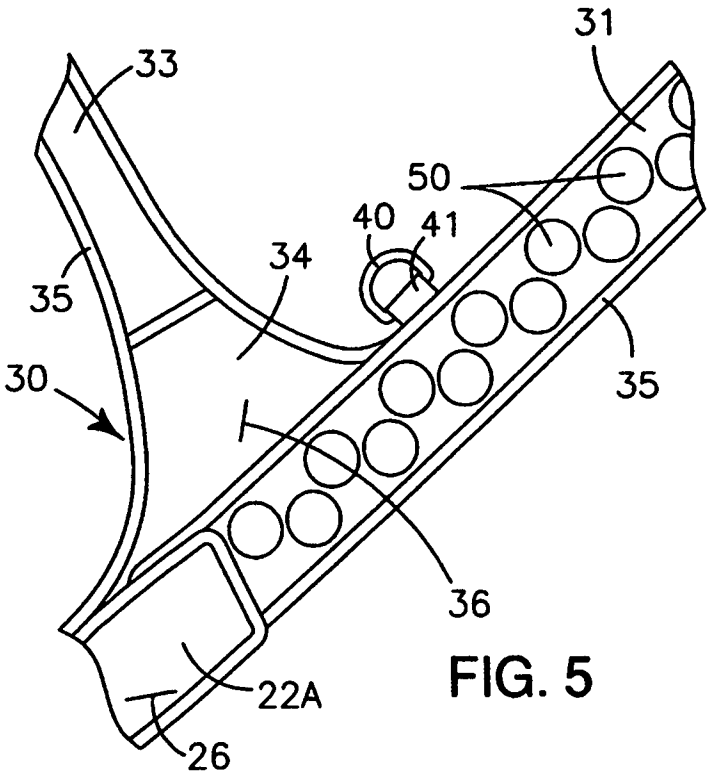
FIG. 5 is an enlarged partial cutaway orthographic side view of the Velcro® attachment patches of the second body portion.

Similar to the second legs 22, 32, the inner surface (not shown) of the first leg 21 of the first body portion 20 carries a plurality of spacedly arrayed Velcro® patches 50, and the outer surface 36 of the first leg 31 of the second body portion 30 carries a plurality of spacedly arrayed Velcro® patches 50 to allow the first legs 21, 31 to be releasably interconnected to one another at a position on a posterior body surface of the user's body. (FIGS. 2, 3). The first legs 21, 31 act as a belt and secure the lower portion of the harness body 10 to the user's body about the user's torso under the bust area.

Halter strap 45 is preferably formed of microfiber material and is elongate having a first end portion 45A and an opposing spaced apart second end portion 45B. In the preferred embodiment, when the harness body 20 is configured to be worn as a halter type apparatus, (FIG. 2) one end portion 45A, 45B of the halter strap 45 is interconnected to the ring 42 at end portion 23A of the vertical leg 23 of the first body portion 20. Similarly, the other end portion 45B, 45A of the halter strap 45 is interconnected to the double D-ring 42 at end portion 33A of the vertical leg 33 of the second body portion 33. Length of the halter strap 45 may be infinitely adjusted by pulling the end portions 45A, 45B of the halter strap 45 through one or both of the rings 42 to decrease or increase the length of the halter strap 45 between the rings 42. (FIG. 1).

Figure 4:
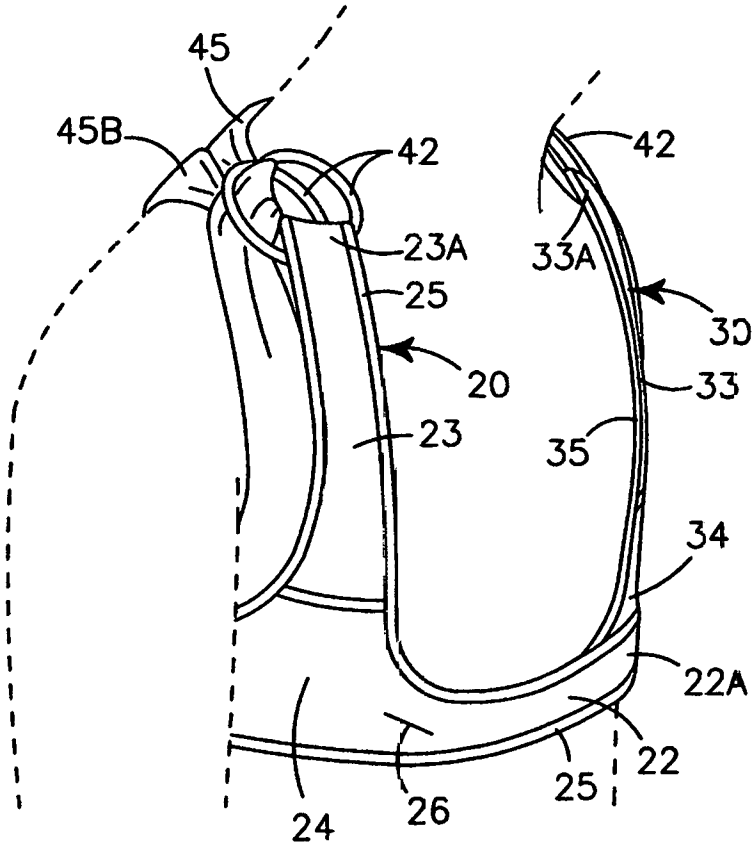
FIG. 4 is an isometric front, right side and top view of the concealed weapon holster harness of FIG. 2.

In use the halter strap 45 is positioned behind a user's neck (FIG. 2) which causes the vertical legs 23, 33 to be drawn upwardly and into a position adjacent a user's chest/upper body. (FIG. 4).

If a user desires to use the harness body 10 with a back crisscross configuration (FIG. 3) one end portion of one crossing back strap 46 is interconnected with the ring 42 carried by the vertical leg 33 of the second body portion 30 and the opposing end of the crossing back strap 46 is interconnected with the single ring 40 carried in the ring 41 of the first body portion 20. The second crossing back strap 47 is interconnected with the ring 42 carried by the vertical leg 23 of the first body portion 20 and also with the ring 40 carried in the ring loop 41 of the second body portion 30 so that the straps "cross" upon the user's back. (FIG. 3). The crossing back straps 46, 47 are used in place of the halter strap 45 providing a second wearable configuration for the instant invention.

Figure 8:
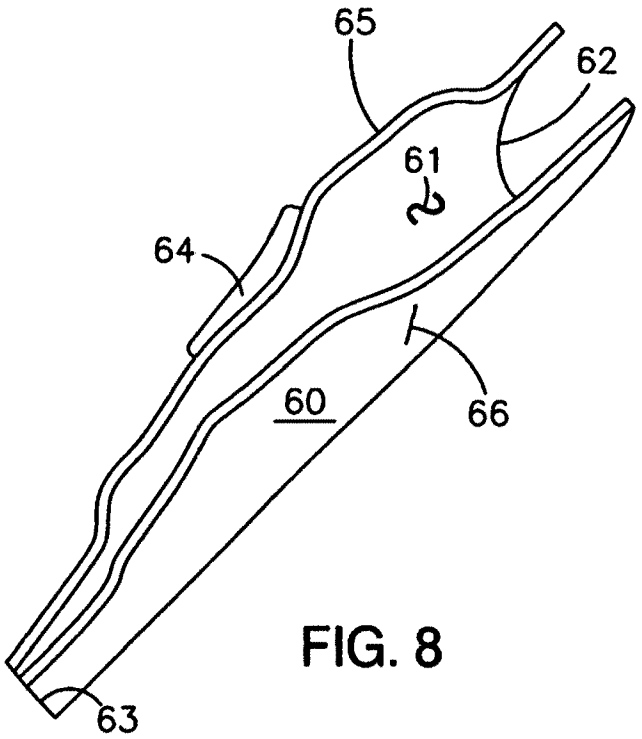
FIG. 8 is an enlarged isometric side view of one embodiment of the weapon holster.

Holster 60 (FIG. 8) is preferably formed of a thin moldable resilient polymer that is lightweight and conformable to the particular firearm. The material comprising holster 60 is preferably a thermal plastic or polymer such as, but not limited to a KYDEX® pistol holster manufactured by KYDEX® LLC, but is not limited thereto, and other materials having the same physical properties may similarly be used. Likewise, holsters formed of leather, fabric, elastic material and the like may similarly be used. In the preferred embodiment the holster 60 is custom designed/built for a small caliber handgun such as would be carried by a female.

The holster 60 has a first surface 65 that is positioned proximate the user's body, and an opposing second surface 66 that is positioned distal from the user body. The holster 60 defines a holster volume 61 and has an upper edge 62, a lower edge 63 and carries a strap attachment on the first surface 65. The strap attachment 64 is preferably a plurality of spacedly arrayed hook portions 51 of the Velcro® patches 50 that releasably interconnect with the opposing loop portions 52 of the Velcro® patches 50 carried at the trunk portion 24 of first body portion 21. Although not shown in the drawings, it is contemplated a plurality of Velcro® patches 50 may similarly be carried upon the trunk portion 34 of the second body portion 30 allowing the holster 60 to be interconnected to the second body portion 30 to accommodate left handed users. The strap attachment may have a variety of configurations including but not limited to, a slot (not shown) defined in the holster 60 for a strap (not shown) to pass therethrough or for the vertical leg 23, 33 to pass through.

Having described the structure of my concealed weapon holster harness and cover, its use may be understood.

The second body portion 30 is positioned so that first end portion 45A of the halter strap 45 may be interconnected with the ring 42 carried by the second body portion 30. The first body portion 20 is similarly positioned so that end portion 45B of the halter strap 45 may be interconnected with the ring 42 carried by the first body portion 20. The halter strap 45 is placed about the user's neck so that the rings 42 are proximate to each shoulder of the user.

The second leg 32 of the second body portion 30 is positioned and held by the user's hand upon the user's midsection anterior surface. Thereafter, the second leg 22 of the first body portion 20 is overlapped upon the second leg 32 of the second body portion 30. It is essential that the Velcro® patches 50 carried on the interior surface (not shown) of the second leg 22 of the first body portion 20 engage with, and interconnect with, the plurality of spacedly arrayed Velcro® patches 50 carried on the outer surface 36 of the second leg 32 of the second body portion 30. The vertical height of the interconnected second legs 22, 32 upon the user's anterior body surface may be adjusted by shortening or lengthening the halter strap 45 where the halter strap 45 interconnects with the rings 42.

Once the vertical height is determined and adjusted, the first leg 31 of the second body portion 30 is wrapped around the user's midsection extending across the user's posterior body surface. The first leg 31 is held in place by the user's hand. Thereafter, the first leg 21 of the first body portion 20 is similarly wrapped around the user's opposing lateral side and extending across the user's posterior surface directly on top of the first leg 31 of the second body portion 30. The Velcro® patches 50 carried by the adjoining surfaces of the second body portion 30 and the first body portion 20 are joined by "pressing" the surfaces together which securely fastens the harness body 10 about the user's body.

The holster 60 is interconnected to the harness body 10 on the side preferred by the user, either at the trunk portion 24 of the first body portion 20, or the trunk portion 34 of the second body portion 30.

Figure 9:
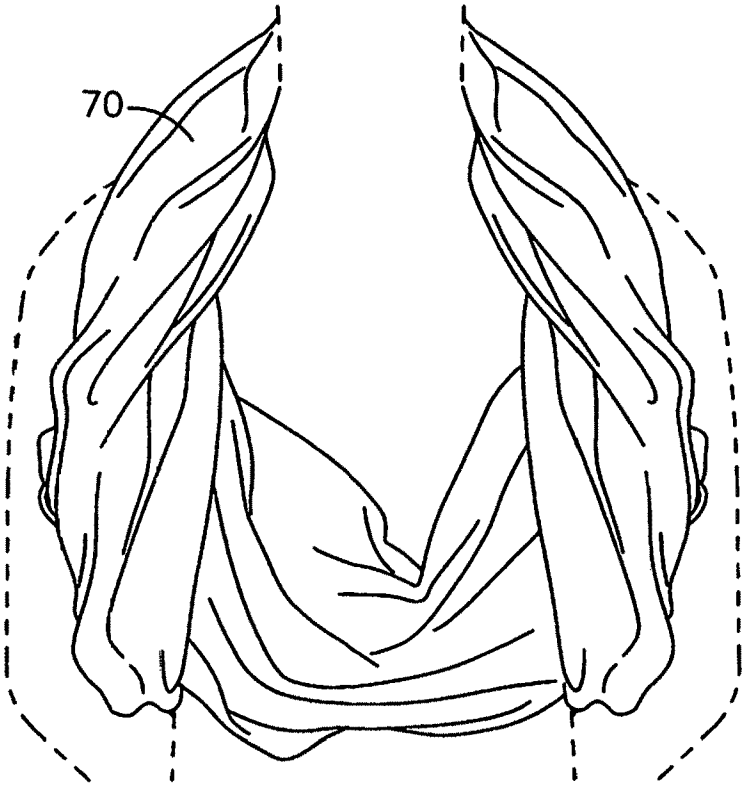
FIG. 9 is a partial cutaway orthographic front view of a woman wearing the concealed weapon holster harness concealed by a scarf.

Covering 70 (FIG. 9) is contemplated to be "shawl-like" in configuration but may also be an elongate scarf that is worn draped about the user's neck and shoulders, and may also be any other loosely draping body covering that is positioned about the user's shoulders and upper body as desired to conceal the instant invention and the firearm 80 carried within the holster 60.

In a second preferred embodiment, not shown in the Figures, it is contemplated the vertical legs 23, 33 of the first body portion 20 and the second body portion 30 are permanently interconnected with a single strap (not shown) extending between the trunk portions 24, 34 and the first leg portions 21, 31 of the first body portion 20 and the second body portion 30 may be separated therefrom to provide the necessary adjustability. In such alternate preferred embodiment, the two vertical legs 23, 33 comprise a single portion having a general "U" configuration to which separate first legs 21, 31 may be releasably attached and adjusted.

If the crossing back strap configuration is desired, the process as described above is repeated except that the crossing back straps 46, 47 are interconnected with the rings 42 of one body portion 20, 30 and the single D-rings 40 of the opposing body portion 20, 30.

Figure 12:
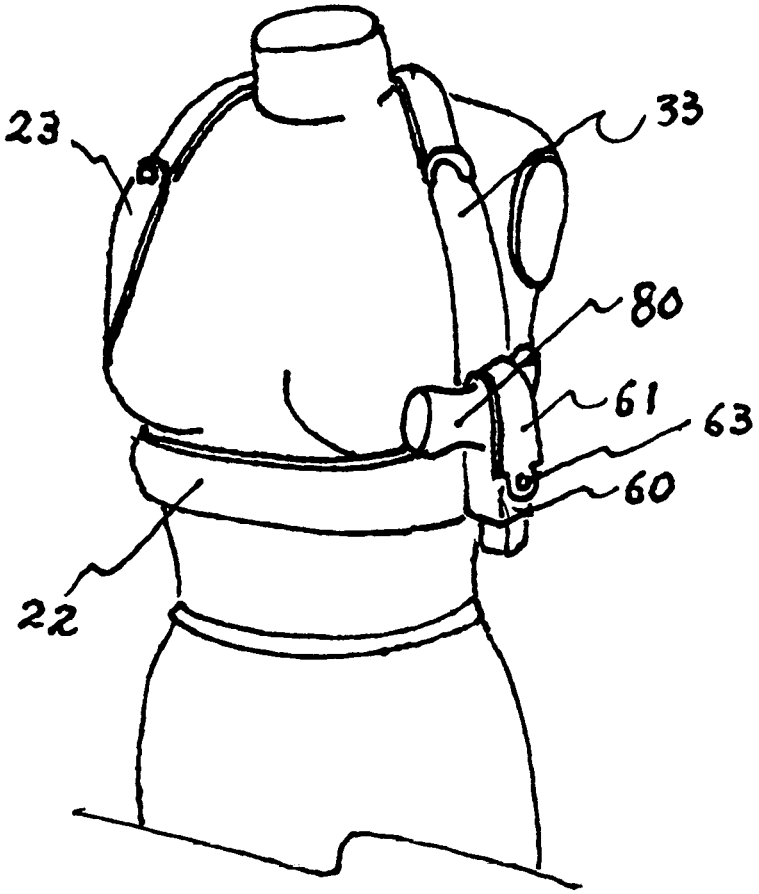
FIG. 12 is a perspective view of an embodiment of the present invention installed on a standard mannequin.

FIG. 12 is a perspective view of the present invention installed on a standard mannequin. In the embodiment shown, the holster portion 60 is made of elastic material to accommodate guns of various sizes. A flexible strap 61 holds the gun 80 in place via a releasable closure member such as a hook and loop fastener. Ring 63 acts as a release tab to help facilitate the quick release of strap 61. A pocket located opposite to the firearm holster can hold a magazine clip.

It is further anticipated that men may like to use this style of holster because it is so easy to "put on" and "take off", especially the halter top version which can easily be "put on" over hunting garments such as coats and even waders.

Various portions and components of apparatus within the scope of the inventions, including for example, structural components, can be formed by one or more various suitable manufacturing processes known to those in the art of firearms and holsters and harnesses therefore. Similarly, various portions and components of apparatus within the scope of the inventions can be made from suitable materials known to those in the art.

The above description has set out various features, functions, methods and other aspects of my invention. This has been done with regard to the currently preferred embodiments thereof. Time and further development may change the manner in which the various aspects are implemented.

The scope of protection accorded the inventions as defined by the claims is not intended to be limited to the specific sizes, shapes, features or other aspects of the currently preferred embodiments shown and described. The claimed invention may be implemented or embodied in other forms while still being within the concepts shown, described and claimed herein. Also included are equivalents of the inventions which can be made without departing from the scope of concepts properly protected hereby.

I claim:

1. A weapon holster system comprising:

a harness body including:

a first harness element including:

a first portion extending in a first direction, the first portion having a first end and a second end; and a second portion extending in a second direction that is transverse to the first direction, the second portion having a first end coupled to the first portion and a second end; and a second harness element including:

a first portion extending in the first direction, the first portion having a first end and a second end, the first end of the first portion of the second harness element being releasably coupled to the first end of the first portion of the first harness element by hook and loop fasteners, the second end of the first portion of the second harness element being releasably coupled to the second end of the first portion of the first harness element by hook and loop fasteners; and a second portion extending in the second direction, the second portion having a first end coupled to the first portion and a second end;

at least one strap adjustably coupled to the second end of the second portion of the first harness element and the second end of the second portion of the second harness element; and a holster member coupled to the harness body.

2. The weapon holster system of claim 1, wherein the holster member includes an elastic portion and a retaining strap, the elastic portion including a band of an elastic material around a cavity configured to accommodate at least a portion of a handgun, the retaining strap having a first end and a second end, the first end of the retaining strap being coupled to a first side of the elastic portion, the second end of the retaining strap being releasably coupled to a second side of the elastic portion, the first side and the second side of the elastic portion being separated by the cavity.

3. The weapon holster system of claim 2, wherein the holster member further includes a pocket to hold a magazine.

4. The weapon holster system of claim 2, wherein the second end of the retaining strap includes a third ring.

5. The weapon holster system of claim 1, wherein the second end of the second portion of the first harness element is coupled to a first ring, the second end of the second portion of the second harness element is coupled to a second ring, and the at least one strap is adjustably coupled to the first ring and the second ring.

6. The weapon holster system of claim 5, wherein the at least one strap is a single strap that has a first end and a second end, the first end being coupled to the first ring and the second end being coupled to the second ring.

7. The weapon holster system of claim 5, wherein at least one of the first portion of the first harness element and the first portion of the second harness element are coupled to a third ring and a fourth ring.

8. The weapon holster system of claim 7, wherein the at least one strap includes:

a first strap having a first end and a second end, the first end being coupled to the first ring and the second end being coupled to the third ring; and a second strap having a first end and a second end, the first end being coupled to the second ring and the second end being coupled to the fourth ring.

9. The weapon holster system of claim 1, further including a pouch coupled to the harness body.

10. A harness system comprising:

a first harness element including:

a first portion extending in a first direction, the first portion having a first end and a second end; and a second portion extending in a second direction that is transverse to the first direction, the second portion having a first end coupled to the first portion and a second end coupled to a first ring;

a second harness element including:

a first portion extending in the first direction, the first portion having a first end and a second end, the first end of the first portion of the second harness element being releasably coupled to the first end of the first portion of the first harness element by hook and loop fasteners, the second end of the first portion of the second harness element being releasably coupled to the second end of the first portion of the first harness element by hook and loop fasteners; and a second portion extending in the second direction, the second portion having a first end coupled to the first portion and a second end coupled to a second ring; and at least one strap adjustably coupled to the first ring and the second ring.

11. The harness system of claim 10, wherein the at least one strap is a single strap that has a first end and a second end, the first end being coupled to the first ring and the second end being coupled to the second ring.

12. The harness system of claim 10, wherein at least one of the first portion of the first harness element and the first portion of the second harness element are coupled to a third ring and a fourth ring.

13. The harness system of claim 12, wherein the at least one strap includes:

a first strap having a first end and a second end, the first end being coupled to the first ring and the second end being coupled to the third ring; and a second strap having a first end and a second end, the first end being coupled to the second ring and the second end being coupled to the fourth ring.

14. A harness system comprising:

a first harness element including:

a first portion extending in a first direction, the first portion having a first end and a second end; and a second portion extending in a second direction that is transverse to the first direction, the second portion having a first end coupled to the first portion and a second end; and a second harness element including:

a first portion extending in the first direction, the first portion having a first end and a second end, the first end of the first portion of the second harness element being releasably coupled to the first end of the first portion of the first harness element by hook and loop fasteners, the second end of the first portion of the second harness element being releasably coupled to the second end of the first portion of the first harness element by hook and loop fasteners; and a second portion extending in the second direction, the second portion having a first end coupled to the first portion and a second end; and at least one strap adjustably coupled to the second end of the second portion of the first harness element and the second end of the second portion of the second harness element.

15. The harness system of claim 14, wherein the second end of the second portion of the first harness element is coupled to a first ring, the second end of the second portion of the second harness element is coupled to a second ring, and the at least one strap is adjustably coupled to the first ring and the second ring.

16. The harness system of claim 15, wherein the at least one strap is a single strap that has a first end and a second end, the first end being coupled to the first ring and the second end being coupled to the second ring.

17. The harness system of claim 15, wherein at least one of the first portion of the first harness element and the first portion of the second harness element are coupled to a third ring and a fourth ring.

18. The harness system of claim 17, wherein the at least one strap includes:

a first strap having a first end and a second end, the first end being coupled to the first ring and the second end being coupled to the third ring; and a second strap having a first end and a second end, the first end being coupled to the second ring and the second end being coupled to the fourth ring.

19. The harness system of claim 14, further including a pouch coupled to the first harness element or the second harness element.

* * * * *